US005467990A

United States Patent [19]

Kitzhaber

[11] Patent Number: 5,467,990

[45] Date of Patent: Nov. 21, 1995

[54] AMBIDEXTROUS GOLF DRIVING NET

[76] Inventor: Jeremy T. Kitzhaber, 6706-D W. Dogwood Dr., USAFA, Colo. 80840

[21] Appl. No.: 260,262

[22] Filed: Jun. 14, 1994

[51] Int. Cl.[6] ..... A63B 69/36

[52] U.S. Cl. ..... 273/181 F; 273/26 A

[58] Field of Search ..... 273/181 F, 180, 273/185 R, 26 A, 400, 181 D

[56] References Cited

U.S. PATENT DOCUMENTS

| | | | |
|---|---|---|---|
| 2,329,992 | 9/1943 | King | 273/181 D |
| 4,381,110 | 4/1983 | Balaz | 273/181 F |
| 4,556,219 | 12/1985 | Tillery | 273/181 F |
| 4,858,922 | 8/1989 | Santavaci | 273/185 R |
| 5,062,640 | 11/1991 | Haley | 273/181 F |
| 5,088,740 | 2/1992 | Peterson | 273/181 F |
| 5,286,029 | 2/1994 | Smit | 273/181 F |

FOREIGN PATENT DOCUMENTS

| | | | |
|---|---|---|---|
| 2661103 | 10/1991 | France | 273/181 F |

*Primary Examiner*—V. Millin

[57] ABSTRACT

A practice net for arresting golf balls hit from a golf tee on a practice mat. The device includes a frame having a first net and a second net relatively, orthogonally oriented, with a practice mat attached between the nets. A left-handed tee is positioned across from the first net and a right-handed tee is positioned across from the second net. Thus, the device may be utilized by either left or right-handed golfers. In addition, a pair of lateral nets flank the first and second nets, and a pair of overhead nets extend from the first and second nets to further contain errant golf balls.

3 Claims, 3 Drawing Sheets

FIG 5
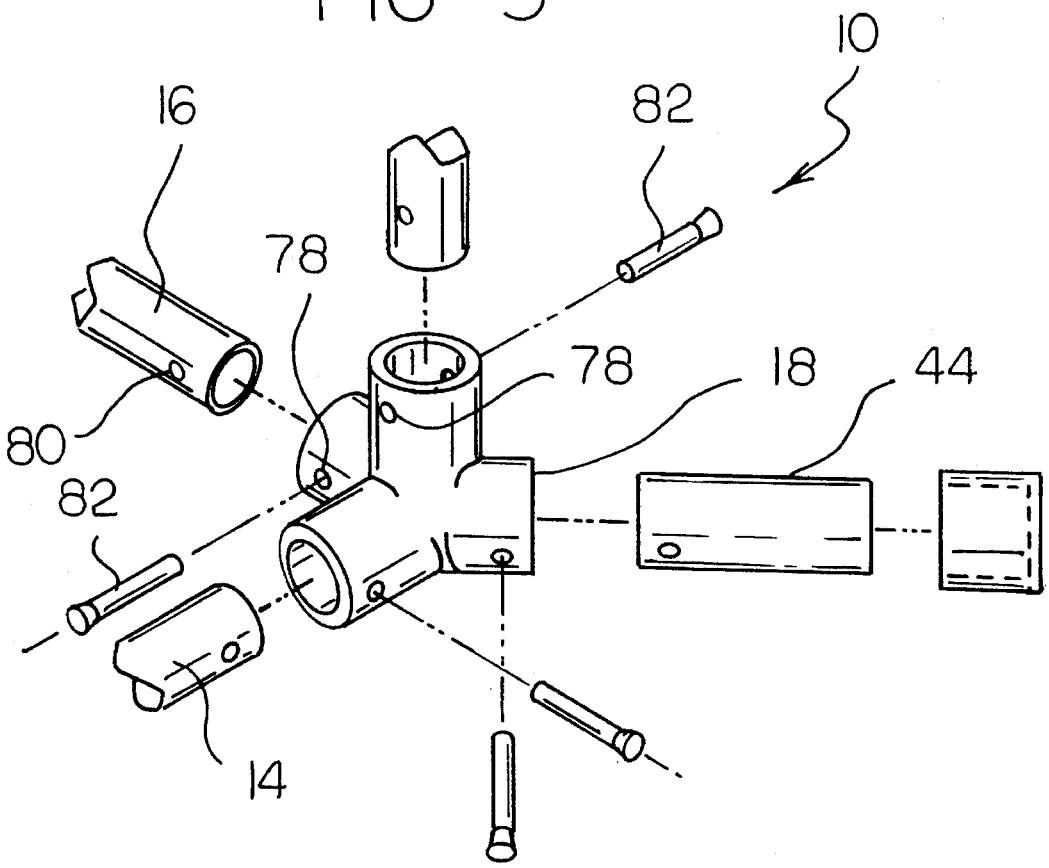
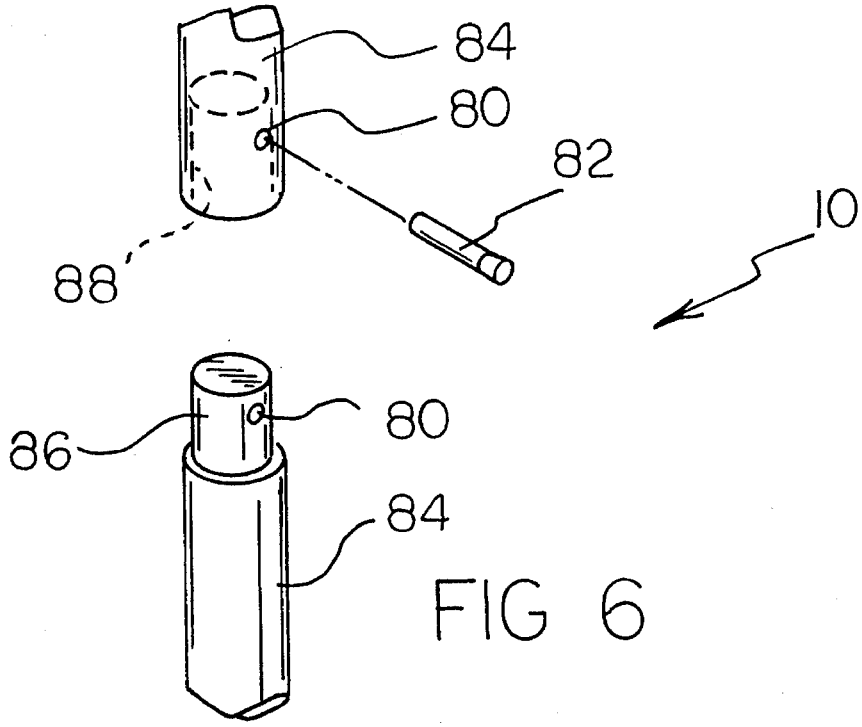
FIG 6

AMBIDEXTROUS GOLF DRIVING NET

BACKGROUND OF THE INVENTION

1. Field of the Invention

The present invention relates to practice devices and more particularly pertains to a practice net for arresting golf balls hit from a practice mat which may include a golf tee thereon.

2. Description of the Prior Art

The use of practice devices is known in the prior art. More specifically, practice devices heretofore devised and utilized for the purpose of arresting golf balls are known to consist basically of familiar, expected and obvious structural configurations, notwithstanding the myriad of designs encompassed by the crowded prior art which have been developed for the fulfillment of countless objectives and requirements.

For example, a practice device for golfers is illustrated in U.S. Pat. No. 5,062,640 which includes a centrally angled "V" or "U" shaped perimeter framework securing a centrally angled net, wherein the framework extends forward of the target to maintain the angled netting in a secured arrangement in use. A mat is provided which is adjustable horizontally either closer to or away from the target by supporting it with a board and shims.

Another patent of interest is U.S. Pat. No. 4,880,239 which teaches a golf training apparatus for ball hitting games having a frame which includes a base as well as a pair of uprights. A net is stretched across the uprights and has a pair of lower net corners which each are connected to a weight organized to ride along a rope inclined about 45 degrees from horizontal and spanning between the base and one of the uprights at a higher point. Thus, displacement of the weights measures an impact of the ball into the net.

Other known prior art practice devices include U.S. Pat. No. 4,969,651; U.S. Pat. No. 4,556,21 9; and U.S. Pat. No. 4,381,110.

While these devices fulfill their respective, particular objectives and requirements, the aforementioned patents do not disclose a practice net for arresting golf balls hit from a golf tee on a practice mat which includes a frame having a first net and a second net relatively, orthogonally oriented, with a practice mat attached between the nets such that a left-handed tee is positioned across from the first net, and a right-handed tee is positioned across from the second net to permit utilization of the driving net by either left or right-handed golfers. Furthermore, none of the known prior art practice devices teach or suggest an ambidextrous golf driving net of the aforementioned structure which further includes a pair of lateral nets flanking the first and second nets, and a pair of overhead nets extending from the first and second nets to further contain errant golf balls.

In these respects, the ambidextrous golf driving net according to the present invention substantially departs from the conventional concepts and designs of the prior art, and in so doing provides an apparatus primarily developed for the purpose of arresting golf balls hit from a practice mat or a ground surface either with or without a golf tee.

SUMMARY OF THE INVENTION

In view of the foregoing disadvantages inherent in the known types of practice devices now present in the prior art, the present invention provides a new ambidextrous golf driving net construction wherein the same can be utilized for arresting golf balls hit from a golf tee on a practice mat. As such, the general purpose of the present invention, which will be described subsequently in greater detail, is to provide a new ambidextrous golf driving net apparatus and method which has many of the advantages of the practice devices mentioned heretofore and many novel features that result in a ambidextrous golf driving net which is not anticipated, rendered obvious, suggested, or even implied by any of the prior art practice devices, either alone or in any combination thereof.

To attain this, the present invention generally comprises a practice net for arresting golf balls hit from a practice mat or ground surface either with or without a golf tee. The device includes a frame having a first net and a second net relatively, orthogonally oriented, with a practice mat attached between the nets. A left-handed tee is positioned across from the first net and a right-handed tee is positioned across from the second net. Thus, the device may be utilized by either left or right-handed golfers. In addition, a pair of lateral nets flank the first and second nets, and a pair of overhead nets extend from the first and second nets to further contain errant golf balls.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new ambidextrous golf driving net apparatus and method which has many of the advantages of the practice device s mentioned heretofore and many novel features that result in a ambidextrous golf driving net which is not anticipated, rendered obvious, suggested, or even implied by any of the prior art practice devices, either alone or in any combination thereof.

It is another object of the present invention to provide a new ambidextrous golf driving net which may be easily and efficiently manufactured and marketed.

It is a further object of the present invention to provide a new ambidextrous golf driving net which is of a durable and reliable construction.

An even further object of the present invention is to provide a new ambidextrous golf driving net which is susceptible of a low cost of manufacture with regard to both materials and labor, and which accordingly is then susceptible of low prices of sale to the consuming public, thereby making such ambidextrous golf driving nets economically available to the buying public.

Still yet another object of the present invention is to provide a new ambidextrous golf driving net which provides in the apparatuses and methods of the prior art some of the advantages thereof, while simultaneously overcoming some of the disadvantages normally associated therewith.

Still another object of the present invention is to provide a new ambidextrous golf driving net for arresting golf balls hit from a golf tee on a practice mat.

Yet another object of the present invention is to provide a new ambidextrous golf driving net which includes a frame having a first net and a second net relatively, orthogonally oriented, with a practice mat attached between the nets.

Even still another object of the present invention is to provide a new ambidextrous golf driving net in which a left-handed tee is positioned across from the first net, and a right-handed tee is positioned across from the second net such that the driving net may be utilized by either left or right-handed golfers.

Even still yet another object of the present invention is to provide a new ambidextrous golf driving net which further includes a pair of lateral nets flanking the first and second nets, and a pair of overhead nets extending from the first and second nets to further contain errant golf balls.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description-makes reference to the annexed drawings wherein:

FIG. 5 is an exploded view of the portion of the invention illustrated in FIG. 4.

FIG. 6 is a further exploded view of yet a further portion of the present invention.

DESCRIPTION OF THE PREFERRED EMBODIMENT

Figure 1:
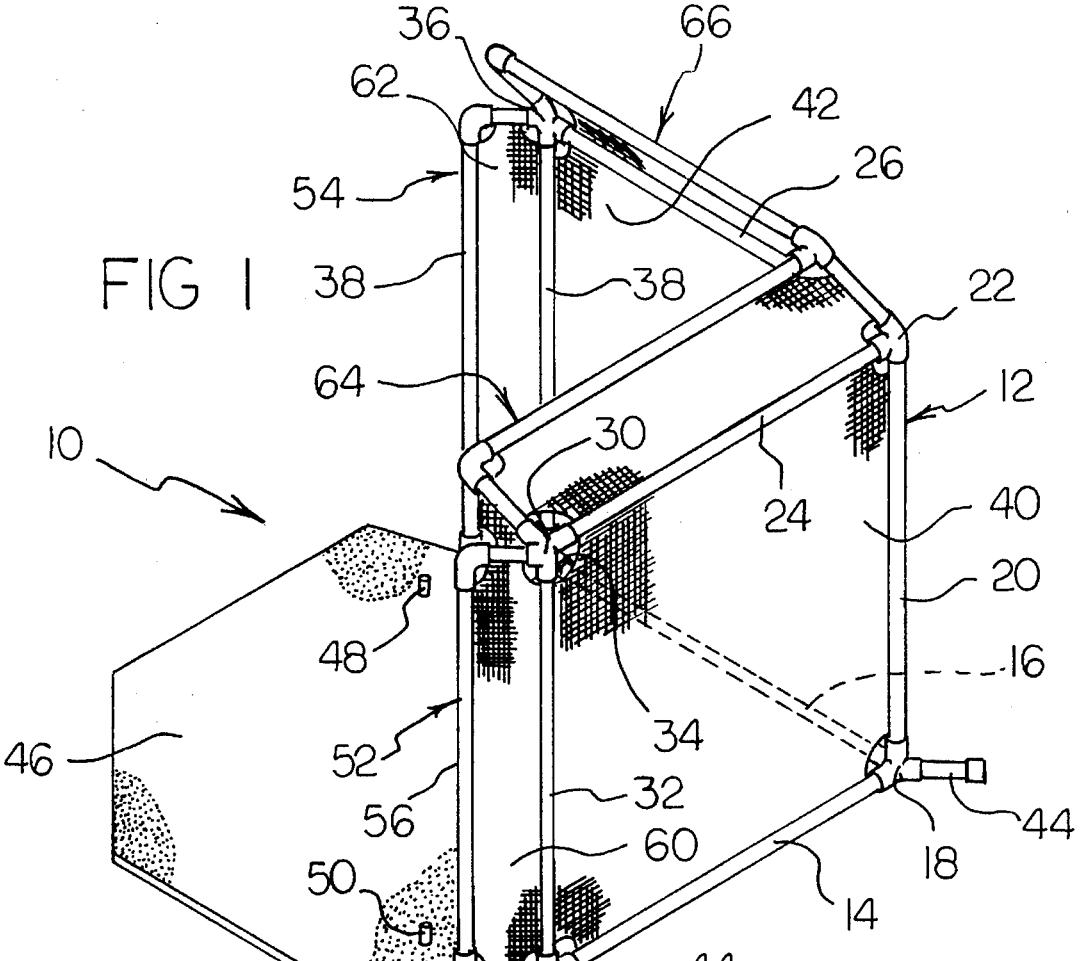
FIG. 1 is an isometric illustration of an ambidextrous golf driving net comprising the present invention.

With reference now to the drawings, and in particular to FIGS. 1–6 thereof, a new ambidextrous golf driving net embodying the principles and concepts of the present invention and generally designated by the reference numeral 10 will be described.

More specifically, it will be noted that the ambidextrous golf driving net 10 comprises a main frame assembly 12 including a first lower frame rail 14 and a second lower frame rail 16 orthogonally joined together by a lower center joiner 18, as best illustrated in FIG. 1. A center support post 20 orthogonally extends from lower center joiner 18 of the lower frame rails 14, 16 to an upper center joiner 22, with a first upper frame rail 24 extending from the upper center joiner parallel to and spaced from the first lower frame rail 14, and a second upper frame rail 26 extending parallel to and spaced from the second lower frame rail 16. The first lower frame rail 14 terminates at a first lower outer joiner 28, and the first upper frame rail 24 terminates at a first upper outer joiner 30. A first outer support post 32 vertically extends between the outer joiners 28, 30 to support the first frame rails 14, 24 in the spaced, parallel relationship. Similarly, the second lower frame rail 16 terminates in a second lower outer joiner 34, and the second upper frame rail 26 terminates in a second upper outer joiner 36, with a second outer support post 38 extending between the second outer joiners 34, 36 to support the second frame rails 16, 26 in the parallel, spaced position.

Extending between the first frame rails 14, 24 and the support posts 20, 32 is a first main net 40. A second main net 42 similarly extends between the second frame rails 16, 26 and the support posts 20, 38. The main nets 40, 42 are operable to capture and arrest a driven golf ball striking either of the nets. To preclude tipping of the device 10 from such impact, a plurality of projecting feet 44 are provided, with an individual projecting foot extending from the center joiner 18, as well as the lower outer joiners 28, 34.

Figure 2:
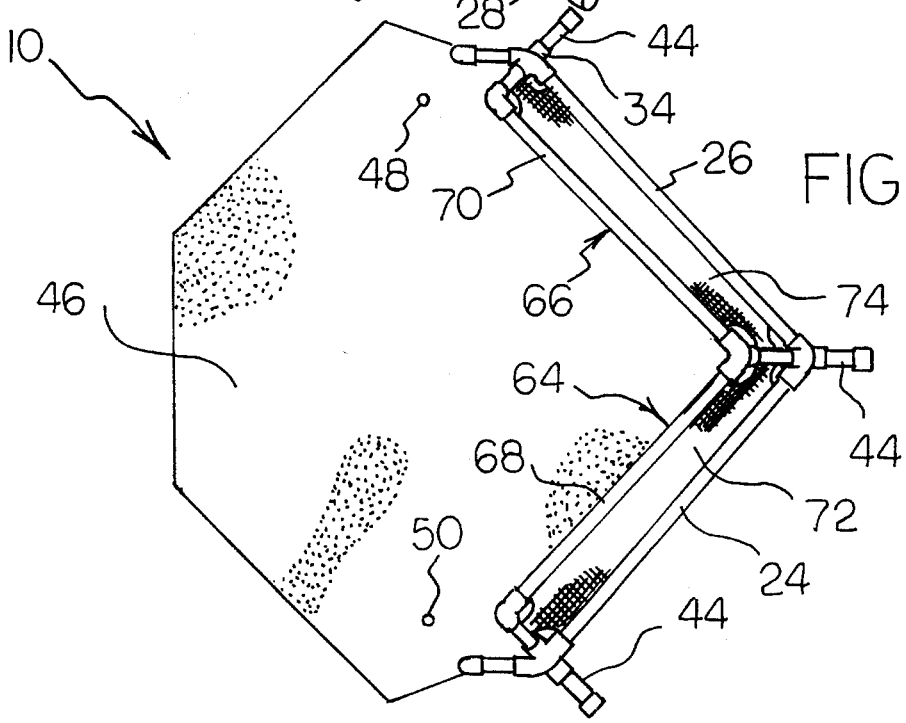
FIG. 2 is a top plan view of the driving net.

As best illustrated in the top plan view of FIG. 2, a mat 46 is coupled to the lower frame rails 14, 16 and is provided with a left-handed tee 48 oppositely positioned relative to the first main net 40, and a right-handed tee 50 positioned oppositely relative to the second main net 42. Thus, a golfer standing on the mat may utilize the left-handed tee 48 during a left-handed stroke to drive an unillustrated golf ball into the first main net 40. Similarly, a right-handed golfer may use the right-handed tee 50 to drive the golf ball into the second main net 42. Further, it is to be noted that the second main net 42 is operable to contain any errant or "sliced" golf balls driven from the left-handed tee 48, and the first main net 40 is similarly operable to contain any errant golf balls driven from the right-handed tee. As such, it can be seen that the main nets 40, 42 are both utilized during use of the device 10 regardless of the particular tee 48, 50 selected.

To further contain errant or "sliced" golf balls, a first lateral net assembly 52 and a second lateral net assembly 54 extend from the respective first and second outer support posts 32, 38. The lateral net assemblies 52, 54 respectively comprise a first lateral frame 56 and a second lateral frame 58 each having a substantially U-shape and being coupled to the respective outer joiners 28, 30 and 34, 36, with first and second lateral nets 60, 62 extending within the respective lateral frames. Preferably, the lateral net assemblies 52, 54 are parallelly oriented as shown in the top plan view of FIG. 2.

In addition to the lateral net assemblies 52, 54 a first overhead net assembly 64 and a second overhead net assembly 66 are also provided. As illustrated in FIG. 2, the overhead net assemblies 64, 66 respectively comprise a first overhead frame 68 and a second overhead frame 70 coupled between the respective upper joiners 22, 30 and 22, 36. A first overhead net 72 extends within the first overhead frame 68, and a second overhead net 74 extends within the second overhead frame 70. The overhead net assemblies 64, 66 are preferably angled inwardly at an angle "A" of approximately 45 degrees from a vertical axis of the center support post 20, as illustrated in FIG. 3.

Figure 3:
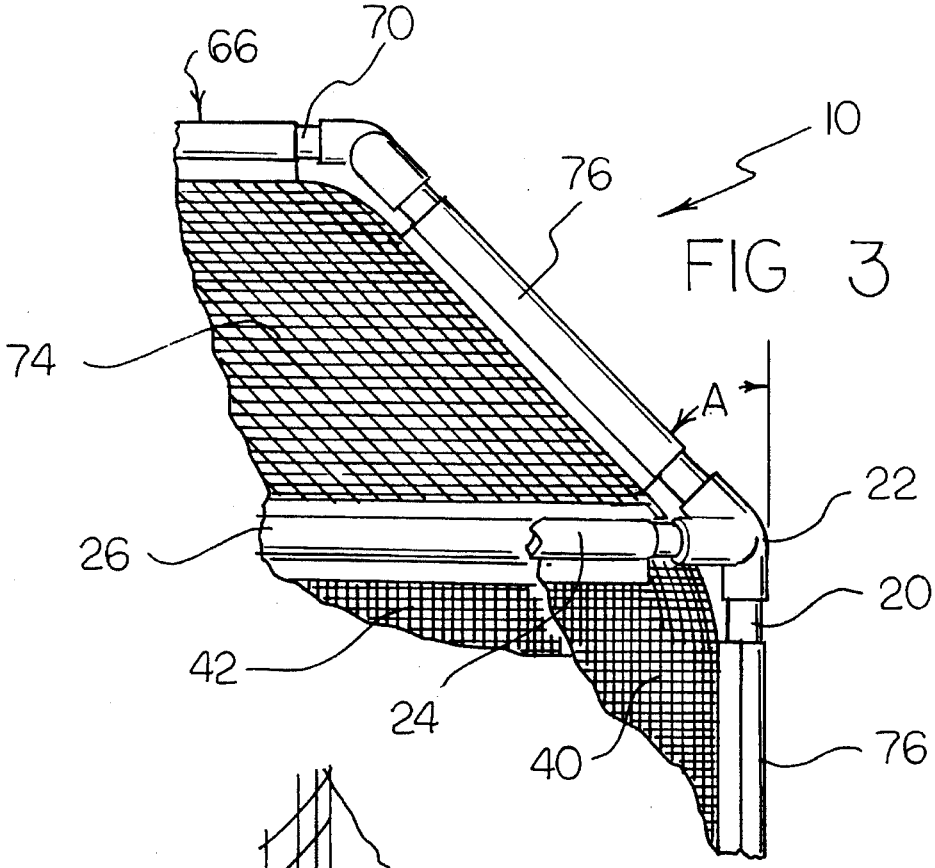
FIG. 3 is a side elevation view of a portion of the present invention.
Figure 4:
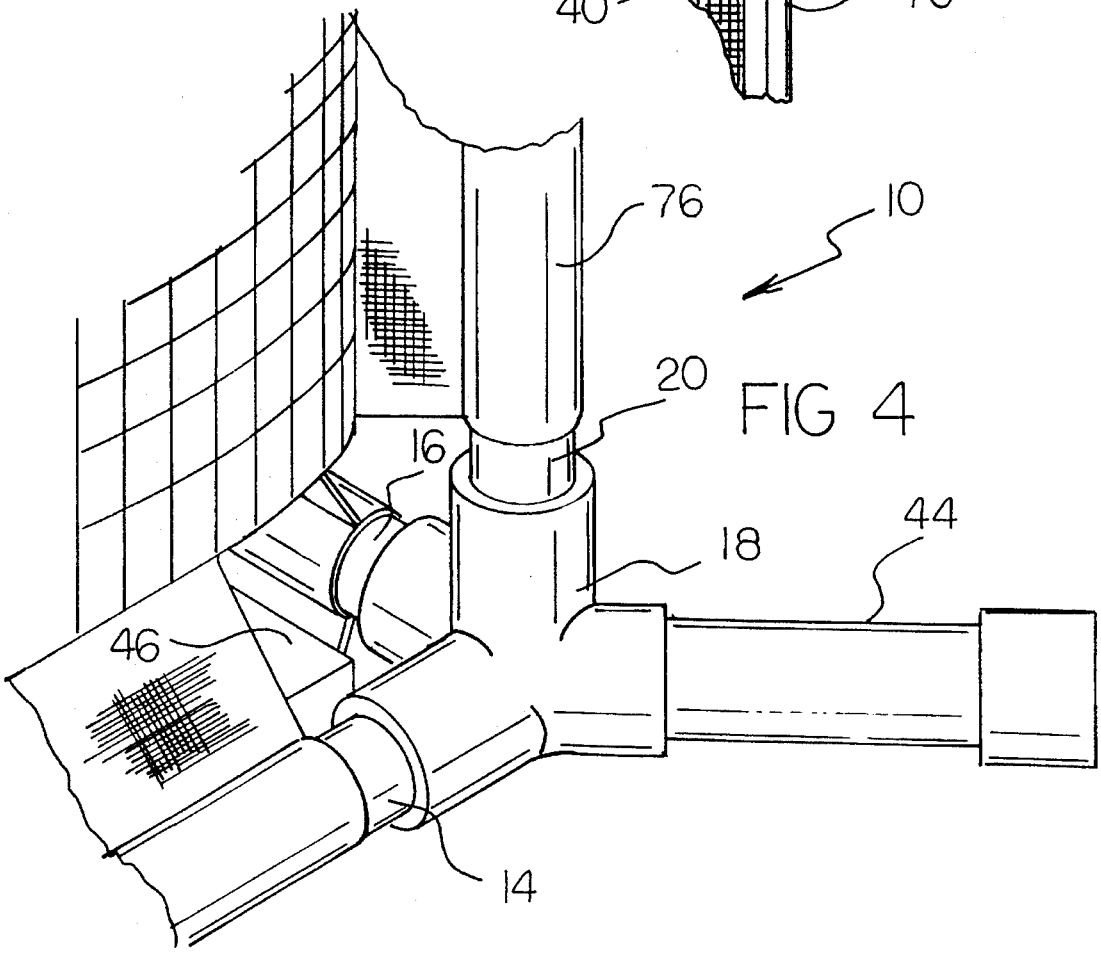
FIG. 4 is an enlarged isometric illustration of a further portion of the present invention.

With continuing reference to FIG. 3 and concurrent reference to FIG. 4, it can be shown that the nets 40, 42, 60, 62, 72, and 74 include mounting sleeves 76 which extend about the frame assemblies. Further, and as illustrated in FIG. 4, the mat 46 is also secured to at least one of these mounting sleeves 76.

Preferably, the device 10 is constructed of round, hollow, tubular members, such as PVC pipe or other similar light weight members, which are removably coupled together as illustrated in the exploded view of FIG. 5. To this end, each of the joiners includes a plurality of apertures 78 which align with apertures 80 in the frame rails and support posts, with pins 82 extending through the apertures 78 and 80 to interlock the components together in a now readily apparent manner, such as is illustrated for joiner 18 in FIG. 5 for example. Although the preferred construction of the present invention 10 includes the use of PVC tubing, it is contemplated that other members, such as square channel, box channel, C-channel, solid rod, elongated poles, or other similar elongated members may be utilized. In addition, it should be noted that the device 10 may be utilized with or without the mat 46 as desired either indoors or outdoors.

FIG. 6 illustrates a further feature of the present invention 10 which allows for further disassembly thereof. To this end, any of the frame rails 14, 16, 24, 26 or support posts 20, 32, 38, or other frames 56, 58, 68, 70 may be comprised of interlocking tubes 84 with each of the interlocking tubes having a projection 86 at a first end thereof which may be received within a cavity 88 located at a second end of an additional interlocking tube. To couple the interlocking tubes 84 together, one of the pins 82 may be positioned through apertures 80 in both the cavity 88 and the projection 86, with such apertures 80 also being utilized to couple the interlocking tube to a joiner as described above.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An ambidextrous golf driving net comprising:

a main frame assembly including a first lower frame rail and a second lower frame rail orthogonally joined together by a lower center joiner; a center support post orthogonally extending from said lower center joiner to an upper center joiner; a first upper frame rail extending from said upper center joiner parallel to and spaced from said first lower frame rail, and a second upper frame rail extending parallel to and spaced from said second lower frame rail; with the first lower frame rail terminating at a first lower outer joiner and the first upper frame rail terminating at a first upper outer joiner such that a first outer support post vertically extends between said first outer joiners to support said first frame rails in a first spaced, parallel position; with the second lower frame rail terminating in a second lower outer joiner and the second upper frame rail terminating in a second upper outer joiner such that a second outer support post vertically extends between said second outer joiners to support said second frame rails in a second parallel, spaced position;

a first main net extending between said first frame rail;

a second main net extending between the second frame rails;

a mat coupled to said frame means, said mat being positioned between said nets, said mat having a left-handed tee positioned in front of said first main net, and a right handed tee positioned in front of said second main net, wherein a left-handed golfer can utilize said left-handed tee during a left-handed stroke to drive a golf ball into said first main net, and a right-handed golfer can utilize said right-handed tee during a right-handed stroke to drive said golf ball into said second main net, with said second main net further being operable to contain an errant golf ball driven from said left-handed tee, and said first main net further being operable to contain said errant golf ball driven from said right-handed tee;

a first lateral net assembly means extending from said first outer support post; and a second lateral net assembly means extending from said second outer support post, said first and second lateral net assembly means being operable for further containing and arresting said errant golf ball; and a first overhead net assembly means extending at an acute angle from said first upper frame rail, and a second overhead net assembly means extending at an acute angle from said second upper frame rail, said first and second overhead support means being operable for still further container and arresting said errant golf ball.

2. The ambidextrous golf driving net as recited in claim 1, wherein each of said nets comprises mounting sleeves means for coupling said net to said frame assembly.

3. The ambidextrous golf driving net as recited in claim 2, wherein said frame assembly comprises interlocking tubes.

* * * * *